United States Patent [19]

LaRosa et al.

[11] Patent Number: 4,534,201

[45] Date of Patent: Aug. 13, 1985

[54] UNDERCUT PUNCH TO CONTROL IRONING

[75] Inventors: John LaRosa, Carpentersville, Ill.; David C. Panipinto, Ontario, N.Y.

[73] Assignee: American Can Company, Greenwich, Conn.

[21] Appl. No.: 454,420

[22] Filed: Dec. 29, 1982

[51] Int. Cl.[3] ..... B21D 22/21

[52] U.S. Cl. ..... 72/348; 220/70

[58] Field of Search ..... 72/348, 349; 220/66, 220/70, 72

[56] References Cited

U.S. PATENT DOCUMENTS

| | | | |
|---|---|---|---|
| 3,760,751 | 9/1973 | Dunn et al. | 72/348 |
| 3,785,311 | 1/1974 | Yoshikawa | 72/348 |
| 3,998,174 | 12/1976 | Saunders | 72/348 |
| 4,403,493 | 9/1983 | Atkinson | 72/348 |

*Primary Examiner*—W. D. Bray

*Attorney, Agent, or Firm*—Paul R. Audet; James B. Kinzer

[57] ABSTRACT

A method and tool for drawing and ironing and bottom profiling a container in a single process operation is disclosed wherein the ironing does not take place during the bottom profiling operation and the precoating of the container side wall is not damaged during removal of the punch because of a specifically configured undercut portion of the punch wall.

11 Claims, 7 Drawing Figures

UNDERCUT PUNCH TO CONTROL IRONING

BACKGROUND OF THE INVENTION

This invention relates to a punch used in connection with the profiling of the bottom end of a 2-piece drawn steel food container which is designed to be packed and then processed at high temperature and pressure in a retort. For the last 25 years, work has progressed on manufacturing drawn can bodies for food products. Drawn containers were made of materials such as aluminum and low temper steels in order to facilitate the drawing operation. In addition to this the containers usually had a height about equal to or less than the diameter of the container and the containers were fashioned in a single or at most two drawing operations. Similarly, the bottom profiles were bellow-like in that they moved in and out to accommodate pressure change during processing.

Only recently has it been possible to make multiple drawn 2-piece food containers which were fashioned from organically precoated tin free steel such that post-coating or post-treatment operations were not necessary. More particularly, a 24 oz. 404×307 tin free steel container was made in a two draw operation. (The can makers convention gives the diameter across the completed doubleseam in inches plus the number of sixteenths of an inch then the height in inches plus the number of sixteenths of an inch). Therefore, the foregoing container is 4 4/16" in diameter by 3 7/16" in height. It has long been desired to be able to make a 2-piece multiply drawn container whose height is appreciably greater than the diameter, using precoated starting material in a multiple draw process. It is also desired to make such a container in the popular 16 oz. 303×406 size or the 15 oz. 300×407 size or the 11 oz. 211×400 size.

The advantage of a drawn container is the elimination of the side seam and one of the double seamed ends present in a traditional 3-piece container. A 3-piece can body is made of a flat blank of material rolled into a cylinder and seamed along one side by welding, cementing or soldering. To this hollow cylindrical body is added a double seamed bottom closure. The cylindrical body may be precoated and the side seam area may be repaired by a stripe. The operations of flanging, side seaming, striping and double seaming are such that the quality of the container is dependent upon those manufacturing steps. In the past it has been the practice to use heavy gauge high strength metal to resist the processing stresses at the double seamed on ends for 3-piece containers e.g., 85 lbs per base box plate. More particularly, such containers include on their ends a deep countersink for strength and chuck clearance and even so those countersinks are subject to buckling during processing.

A 2-piece can with an integral bottom does not require a bottom end chuck countersink for double seaming, but a bottom recess is necessary in order to manufacture a 2-piece can with the same height and capacity as a conventional 3-piece can so that either may be interchangeably used in the same packing and processing line. The large capital investments in equipment for handling 3-piece cans in the packing plant cannot be merely written off. A 2-piece container which will physically resemble the 3-piece container is essential in order to permit continued use of the existing 3-piece equipment, e.g., labelling, runways, retort, etc.

Bottom profiling has been used to apply ribs, creases and the like to add rigidity to the bottom of the 2-piece can. The weakest area of a drawn 2-piece can is the bottom because the material thickness of the steel for 2-piece cans is about 65 lb plate and is less than a seamed on 3-piece end. With the thinner bottom of a 2-piece container strength required to give adequate buckle resistance is a function of the bottom configuration. With only moderate profiling, the pressurized 2-piece can bottom may distend and exceed the elastic limit of the metal. When that happens the can is unacceptable as it will rock about its distended bottom and appear to contain tainted or spoiled contents, as would result from the evolution of hydrogen gas. Consequently, a bottom profile is necessary to improve the performance of thin-two-piece cans. If the profile includes a relatively deep recess designed to have work hardened areas of metal, the elastic limit of the bottom metal is increased particularly in areas of high stress. The highly worked bottom is more rigid and is not bellow-like in configuration because the reverse drawing of the bottom profile increases the strength and decreases the container volume.

Each hermetically sealed container must be retorted to prevent bacterial growth and spoilage which will generate metabolic products such as organic acids and carbon dioxide; the latter tending to inflate the sealed container causing it to bulge or become unseamed. In order to have commercial sterility (safety) the food must be heated to a state which renders it free of viable forms of micro-organisms which are there or which would reproduce in the future under normal storage conditions. Cans with hermetically sealed contents heated above their boiling point and then cooled subjects the bottom profile to internal pressure and then external pressure. Similarly, certain groups of high acid foods need not be retort processed since these acidic foods are hot packed. That is to say that, they are heated to near the boiling point and then packed in the container. Even hot packing places considerable pressure stress on the container. The bottom and top ends get more of the pressure load. The top end can be made of heavier plate whereas the bottom end of a 2-piece container is of the minimum gauge from which the container body may be drawn so that the weight of the container and the thickness of the side walls are kept to a minimum. Spoiled contents will then tend to first force outward the seamed on top and simplifing the process of checking the packed cans.

It is very difficult to form such bottom profiles by reverse drawing without highly stressing the metal in the body sidewall and bottom since there is considerable stretching required in order to generate a bottom recess deep enough to provide the height to volume ratio of a similar 3-piece container. Moreover, DR9 plate is double reduced and any work hardening causes that highly stressed metal to quickly reach its ultimate tensile strength.

The preferred embodiment of and method for producing a 2-piece container of a minimum amount of the high temper double reduced steel involves one to three concurrent drawing operations which may take place in a press as disclosed in U.S. Pat. No. 4,262,510 (incorporated herein by reference) which is assigned to the same Company as the present invention. To make a triple drawn can by drawing and ironing, the first operation blanks and then forms a sheet of precoated material into a shallow cup with a diameter in excess of its height. In the second operation the diameter is reduced and the height increased so that they are about equal in the container formed. The last operation reduces the diameter still further such that the container achieves its final configuration. During this last operation the bottom profile is reverse drawn into the container. After that reverse draw the bottom profile has all the essentials of the final desired profile including, for example, a domed central recess. The drawn can bearing that preferred profile shape has an annular flat outer circumferential portion extending from the lowermost corner of the sidewall and bottom inwardly to an upwardly and inwardly slightly inclined annular wall concentrically located relative to the central longitudinal axis of the can. The annular wall tips slightly toward the axis of the can and extends inwardly towards the outward circumferential portion forming the boundary of the central domed recess. The dome is essentially parallel to the bottom plane defined by the aforesaid flat circumferential portion radially outward of the central domed recess. The central recess is essentially parallel to the bottom plane defined by the aforesaid flat circumferential portion in that the same forms a relatively shallow and long-radius dome when formed by doming inwardly along the axis of the container body.

During the drawing and ironing operations used to form and reform, high clamping forces are needed. Conventional drawing of cups, box shapes, or irregular panels causes wrinkles to occur at the outer region of the blank and to prevent wrinkling in the first draw die, blankholders are used to clamp. The clamping force will vary with variation in sheet-metal thickness. Normal variations in sheet-metal thickness can cause problems. Thinner sheet thickness reduces the clamping force resulting in wrinkles. Thicker sheet could, on the other hand, cause tearing due to excessive clamping force. The clamping force causes the sheet metal to thicken rather than wrinkle under the squeezing loads of clamping. Because too much force will cause either tearing and too little force wrinkling of the sheet metal, the clamp force is critical. Constant pressure is desirable for clamping, particularly for the start of the drawing process. Actual clamping force requirements are determined by trial and error as the draw die is tried out. Clamping restrains the movement of metal through the die and imparts stretching forces to the container being formed.

The metal working of the bottom panel which provides the central recess is done in such a manner that the amount of material in the initial blank is not increased as much as the recess requires. More particularly, the central recess is formed substantially from stretching and pulling the metal from the side wall into the bottom panel. This is beneficial from the standpoint of economical material usage and is important from the standpoint of work hardening primarily the bottom and side wall to improve their yield strength, but same is detrimental from the point of view of metal flow during the reverse drawing of the bottom recess. That is to say that, the clamping of the metal to prevent wrinkling during drawing is about the flange and so the force applied to the bottom during the reverse drawing of the domed recess must pull metal from the entire sidewall into the bottom profile. During reverse drawing sidewall and bottom metal are stretched over a domed punch nose causing the sheet to thin at the crown of the dome. To assure metal stretching without wrinkles, the clamping force must be high enough to prevent or greatly retard uncontrolled movement along the punch.

If ironing is added to the process the problem of reverse redraw stress is increased since the sidewall is clamped not way up at the flange but along the sidewall closer to the area from which metal must be pulled into the bottom profile. Ironing is most desirable from a manufacturing economics and performance standpoint since less metal is required to make the container body and because the finished can body has been work hardened to a higher level. The high temper low stretch double reduced plate cannot be stretched more than 5 to 10% without increased risk of fracture. In particular, stretching of larger percentage amounts causes tearing of the sidewall or breaking of the dome in the bottom profile. With ironing stretch of 16 to 18% has been measured in a typical 303×406 container.

With low temper materials capable of stretching or with unironed sidewalls or with a combination of those, the bottom profile can usually be formed without tearing or breaking the can during the reverse draw of the domed recess. The economics of commercial can production necessitate the use of high temper (DR 8 or 9 steel), thin guage (65 lb) plate, ironed in order to prove adequate strength and light weight in a 2-piece container. Thus, a way in which commercially practical containers could be made with the requisite bottom profiling necessary for 3-piece interchangeability and to overcome the end stresses of packing and processing had to be found.

OBJECTS OF THE INVENTION

It is an object of the present invention to provide a tool for controlled ironing of the side wall of a container made from relatively high temper material which must be redrawn, ironed and bottom profiled in the same forming operation.

It is a further object of the invention to provide a tool for ironing during part of a redrawing operation but no ironing during most of the bottom profiling portion of that operation.

SUMMARY OF THE INVENTION

The present invention relates to new tooling designs which reduce the incidents of bottom profiling and side wall fractures, tears and breaks of containers that are made by the process of drawing and redrawing with wall ironing. In particular, drawing and redrawing processes with ironing where the bottom profile is concurrently formed during the process of redrawing by reversely forming by drawing and stretching a domed recessed profile into the bottom. That is to say that, the problem of the side wall being restrained by the ironing process while the bottom profile is being formed is solved by selective undercutting along the punch. Consequently, the bottom profile can be formed of material from the container side wall as same is allowed to shift axially along the punch wall, around the punch nose and into the bottom profile of the container. While ironing inhibits the axial flow of metal along the punch wall during the bottom profiling, the increased annular clearance, between the punch wall and the ironing land of the die forms a space through which the container side wall can easily pass.

Undue stretching which leads to fractures, breaks and tears is eliminated when a portion of the punch wall is recessed in the area where the ironing land of the die is when the bottom profiling takes place. The recess or undercut is a diametrical reduction in the punch cross section along an axial extent of the wall portion of the punch which is adjacent the ironing land when the container is bottom profiled. More specifically, the reduced diameter coincides with the die ironing land only at the time when the punch stroke is positioned for bottom profiling except at the very end of the profiling stroke. The reduced diameter results in increased punch to die clearance during most of the bottom profiling and thereby eliminates wall ironing during that time wherefor axial flow of the metal along the punch wall is permitted allowing the profiling without detrimental increase in metal stretch. Consequently, high temper metal is usable without concern for excess stretch or elongation resulting in fractures.

Contrary to what would be expected, the undercut portion of the punch does not axially extend to thicken the sidewall all the way up to the flange. This is because the container is formed of precoated stock which must be handled with a degree of care in order to protect the integrity of the precoating. Specifically, the container is ironed above the area of the undercut as well as below. It is essential to resume ironing for the last portion of the punch stroke in order to thin the container side wall material and preventing inside coating damage during removal of the punch from the finished container. That is to say that, the container side wall cannot be left completely unironed over its remaining upper portion i.e., that extending from the point on the sidewall (reached by the ironing land when the bottom profiling has been completed) to the flange. There must be some ironed portion above the unironed portion to aid the undercut punch upon withdrawal from the container. The unironed portion of the side wall adjacent the undercut is not ironed during punch removal because same does not occur when the die is adjacent from an unironed portion of the container. The thicker sidewall adjacent the undercut acts to hold the container on the punch and inhibits removal. The undercut has a gently angled ramp portion which during removal cams the thicker portion diametrically outward to allow removal of the container. This is possible only when the ironing land is no longer against the unironed portion, see FIG. 7.

The gentle angular relationship of the ramp between the bottom of the undercut and the full diameter of the punch wall permits removal by first expanding the container diameter in the thicker side wall area. When the area of the upper ironed portion is reached, the coating is protected because of the ironed reduction in thickness. Once the punch has been pulled from the container sufficiently to align the full diameter of the punch with the upper ironed portion of the container side wall (just above that which was unironed portion) the lessened radial loading avoids scuffing which would carry the remaining coating with the punch. Consequently, the side wall forming of the container by the undercut punch produces a container that is generally uniform in thickness and strength where ironed during the forming of the container. Fractures, tears and breaks due to overstretching the metal are eliminated.

DETAILED DESCRIPTION OF THE DRAWINGS

Figure 1:
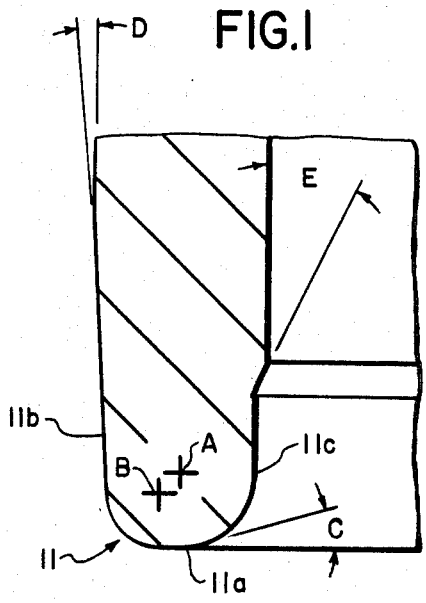
FIG. 1 is an enlarged partial cross sectional view of the punch nose for the present invention.

FIG. 1 shows details for a preferred embodiment punch 10 designed to make a 300 by 407 container in a redraw operation with ironing and bottom profiling and specifically the enlarged cross section of the punch nose of the present invention. The punch nose is generally labeled 11 and has an inner nose radius A and an outer radius B both 0.090" long. The end of the punch is angled inwardly such that the face 11*a* of the punch nose is at angle C of 14°, twelve minutes relative to a plane normal to the axis of the punch. The positions of the centers for A and B are established by first tapering relative to the punch axis the outside 11*b* of the punch nose 11 at angle D of 0°, fifteen minute±five minutes and the inside taper into the hollow center at an angle E of 30°. The taper D starts at 0.50" from the end of the punch face 11*a*. The center for radius B is thus established at 0.090" from outside 11*b* and from face 11*a*. The center of radius A is 0.125" to 0.120" from the outwardmost part of face 11*a* and is such that its radius of 0.090" is tangent to the inwardly angled part of that face 11*a* and the inside 11*c* of the punch nose 11.

Figure 2:
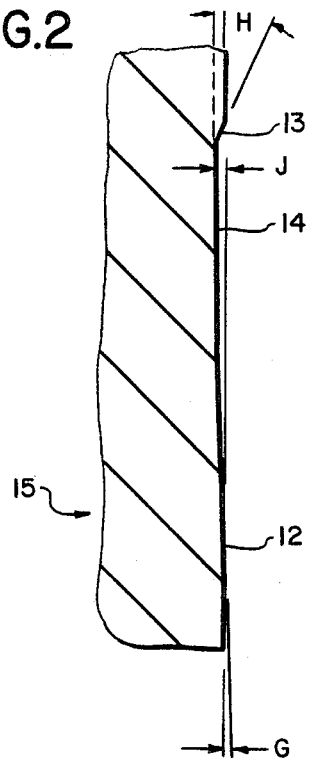
FIG. 2 is an enlarged partial cross sectional view of the side wall of the punch in the area of the undercut of the present invention.

FIG. 2 shows the enlarged upper side wall 15 of the punch 10 in the preferred embodiment and, in particular, the undercut portion formed by a transition ramp 12 disposed at an angle G of 0° 25 minutes relative to the axis of the punch. The transition ramp 12 eventually reaches toward an angled wall 13 which extends outward to the full diameter. Angled wall 13 is angled with respect to the axis of the punch at an angle H which in the preferred embodiment is about 4° 34' with respect to the axis of the punch 10. The axial length of the angled wall is only 0.025" and the depth of the undercut is only 0.002". Thus, the angle of angled wall 13 is a function of tolerances and the tool maker's skill. Between transition ramp 12 and angle wall 13 there is a flat section 14 being parallel of the axis of the punch sidewall 15 see FIG. 3. This flat section 14 extends axially approximately 0.325" and the transition ramp 12 extends axially about 0.250". Flat section 14 is approximately 0.0020" recessed into the side wall 15 of the punch 10 as illustrated by the arrows at J in FIG. 2.

Figure 3:
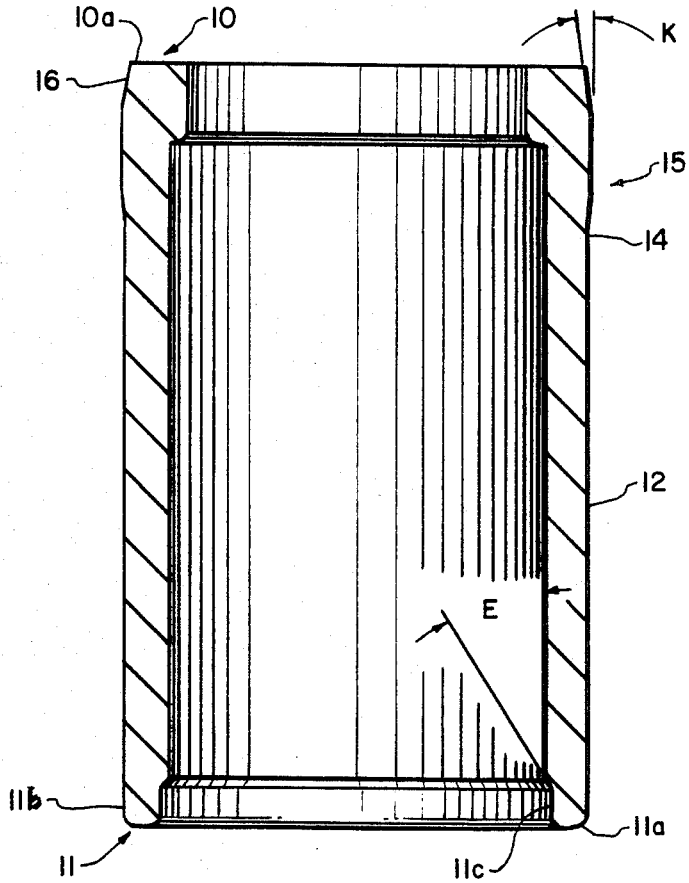
FIG. 3 is a side cross sectional view taken along line 3—3 of FIG. 4 of the punch of the present invention.

FIG. 3 shows the overall cross sectional view of the punch 10 and in particular the angular relationship K, of the mounting end 10*a* of the punch 10, which is 1° forming a chamfered mounting surface 16 which is about 0.25" in axial length. In the preferred embodiment the overall width of the outside diameter of the punch 10 is 2.8830"±0.0001. This would be at the largest diameter of the punch 10 above and below the flat 14 which would be 2.879" in diameter±0.0001.

Figure 4:
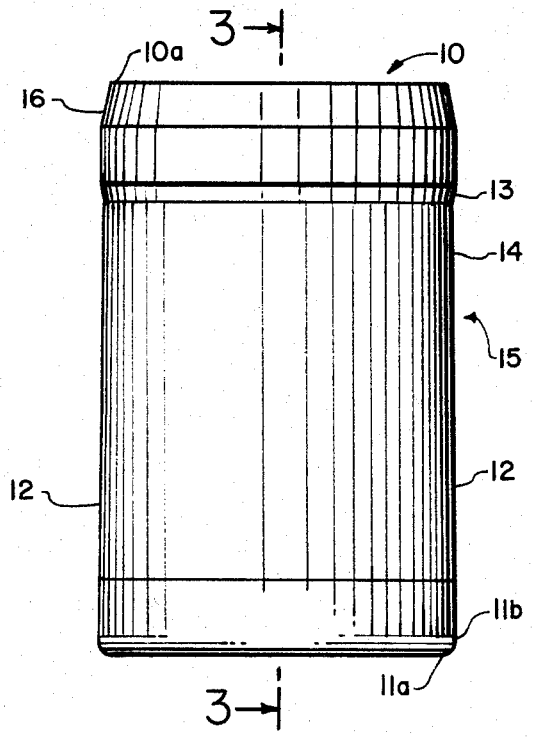
FIG. 4 is a side elevational view of the punch of the present invention.

Turning now to FIG. 4 which shows the overall side elevational view of the punch 10 and includes the sectional lines 3—3 showing the cut or cross-section at which FIG. 3 is taken i.e., through the middle of the punch 10. Punch 10 is cylindrical in configuration and has a circular cross section. The relief defined by transition ramp 12 and flat section 14 described in connection with FIG. 2 is accentuated to some degree in FIG. 4 for purposes of illustration and FIG. 4 is not to scale being only for purposes of showing the overall configuration punch 10.

Figure 5:
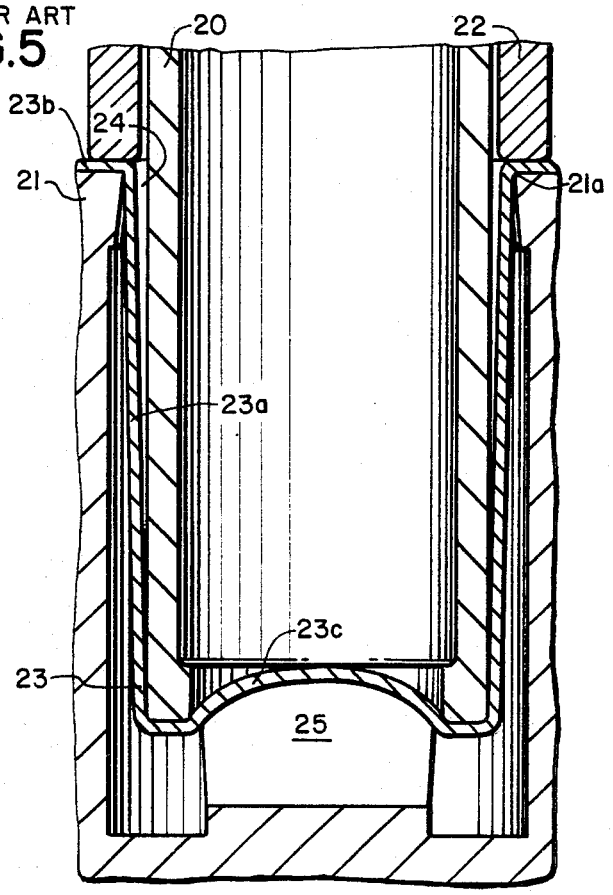
PRIOR ART FIG.5
FIG. 5 is a side cross sectional view of a punch and its cooperating die for forming a container having bottom profiling; this punch and die cooperate to merely draw the container but do not iron it.

FIG. 5 shows a different punch labeled 20, a draw die labeled 21 and a clamping sleeve labeled 22 holding a fully formed drawn but not ironed container 23. It will be noted that the die 21 has no ironing land but merely a draw die radius at 21*a* such that the side wall 23*a* of the container 23 is free to stretch from the container flange 23*b* when a bottom doming tool 25 is applied to bottom profile 23*c* of the container 23. The profiling process is reverse drawing during the redraw of the container 23 between the punch 20 and die 21. Specifically, in the embodiment of FIG. 5 the bottom drawing tool 25 contacts the container bottom 23*c* during the redraw stroke when the container is just about 80 to 90% complete such that metal is being drawn over the radius 21*a* and into the bottom dome 23*c* at the same time. There is no undercut on punch 20 and none is required since the flange 23*b* and sidewall 23*a* is available to stretch and shift into the bottom profile 23*c*.

Figure 6:
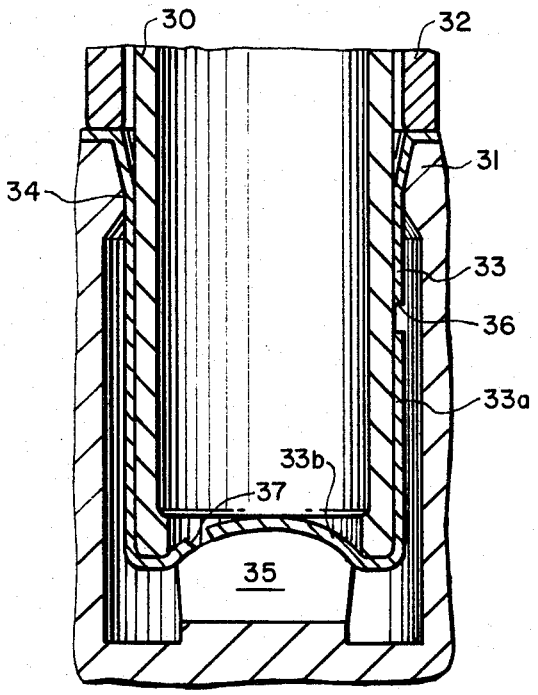
PRIOR ART FIG.6
FIG. 6 is a side cross sectional view of a punch and its cooperating drawing and ironing die showing a drawn and ironed container with bottom profiling. A side wall fracture and a bottom dome fracture are shown on the container and result from stretching the metal beyond its ultimate strength.

In FIG. 6, similar tooling is shown and specifically the punch 30, the drawing and ironing die 31, the clamp sleeve 32, and the container 33. There is no clearance between the container 33, the drawing and ironing die 31 and the punch 30 because there is an ironing land 34 which holds the side wall of the container 33 tightly against the side of the punch 30 to iron and thin the side wall 33*a*. When the bottom dome tool 35 contacts the bottom 33*b* of the container 33, tension loads are applied to the container 33 in the side wall 33*a* and/or the bottom 33*b*. These tension loads stretch the material and consequently tears or breaks can form in the side wall 33*a* and the bottom wall 33*b* such as those depicted in FIG. 6 at 36 and 37 respectively.

As stated the tension loading in the drawn but not ironed container 23 of FIG. 5 extends from the flange 23*b* therein to the bottom 23*c* whereas the loading in the container 33 which is drawn and ironed as shown in FIG. 6, can only extend from the side wall 33*a* of container 33 (below the ironing land 34) to the bottom 33*b*. Consequently, the level of stress attained is greater then in a nonironed container such as 23 of FIG. 5. In particular, in a process where the ironing and the bottom profiling are taking place at the same time since the distance from the ironing land 34 to the bottom 33*b* along the side wall 33*a* is less under that situation.

Figure 7:
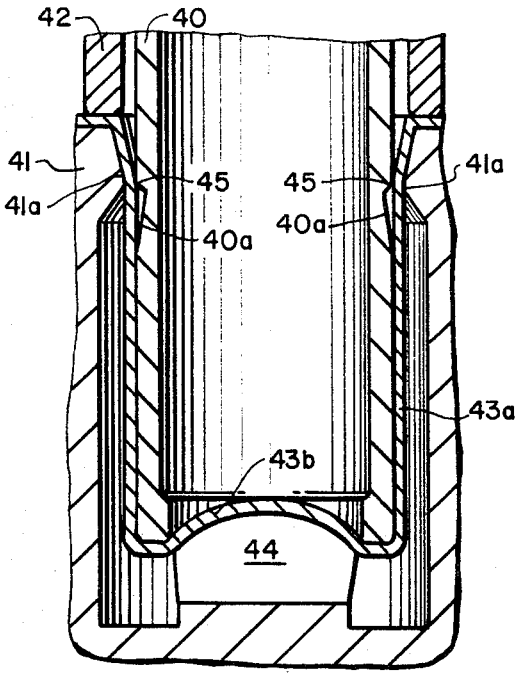
FIG. 7 shows a side cross sectional view of the punch of the present invention and its respective drawing and ironing die wherein the container is drawn and ironed and does not fracture because of an undercut provided on that punch wall.

Turning now to FIG. 7 wherein the improvement of the present invention is shown and more particularly the undercut punch 40. Punch 40 is shown within and extending through a drawing and ironing die 41. A clamping sleeve 42 is coaxially disposed about the punch 40 to hold a drawn and partially ironed container 43 having side wall 43*a* and a bottom profile 43*b*. The punch 40 has a relief generally designated 40*a* and more specifically designed and fashioned as shown and described in connection with the enlarged punch portion of FIG. 2 whereby the container 43 is formed without undue stretching during the bottom profiling operation which occurs when the bottom profiling tool 44 reverse redraws the container bottom 43*b* into the hollow center of the punch 40.

It has been found that the stretch capability of the double reduced plate which is used in the preferred embodiment, requires that the container be relieved of ironing stress during bottom forming. If the container 43 is not so relieved during bottom profiling the condition shown for container 33 of FIG. 6 arises. Moreover, ironing must resume when bottom profiling is being completed, therefore, the area 45 shown in FIG. 7 indicates the overlap or portion where the ironing land 41*a* of the die 41 again begins to iron the container side wall 43*a* near when the bottom profiling is completed. This overlap is for an axial distance of about 0.10" and represents a sufficient amount of profiling ironing to enable stripping (container removal from the punch) without damage to the inside coating.

More specifically, the reironing bottom profiling thins the side wall 43*a* in the area 45 to sufficiently permit the completed container to be stripped from the punch without damage to the inside coating. This is because the unironed portion of sidewall 43 is spread radially outward as the area of the punch called the transition ramp is pulled past the unironed section. Therefore, there is no coating damage because there is no ironing during removal of the punch.

Those skilled in the arts to which this invention pertains will appreciate that other arrangements will relieve the sidewall tension loading during the bottom profiling operation thereby duplicating the ease of manufacturing an unironed container while maintaining the benefits of efficient material usage and high strength derived by use of ironing. The improvement described and illustrated dramatically reduces breaks and tears. The number of damaged containers per thousand manufactured is reduced on the average to 1/20th of what it would be without the use of the present improvement.

The claims which follow are to be read in light of the invention as a whole and not limited to the dimensions or details of the preferred embodiment.

What is claimed is:

1. A method of drawing and ironing a thin walled cylindrical article from material comprising the following steps:

(a) forcing the material through a drawing and ironing die on a punch to form an elongated cylindrical article the side walls of which are reduced in thickness compared to the bottom;

(b) applying a bottom forming tool axially toward said punch while same is forcing the workpiece through said die;

(c) removing the ironing load during the application of bottom forming by means of reducing the diameter of said punch in the area across from the ironing portion of the die, and (d) resuming ironing of the side wall near the end of the bottom forming said ironing sufficient to effect a thinning of the side wall above the unironed, unthinned sidewall portion.

2. The method according to claim 1 wherein the material is an organically precoated tin free steel.

3. The method according to claim 1 wherein the method takes place as one operation of a plurality of forming steps to produce a precoated drawn and ironed food container.

4. The method according to claim 1 wherein the bottom forming stretches the material and shifts material from the side wall into the bottom.

5. The method according to claim 1 wherein the material is a circular blank of tin free steel with an organic coating on the inside and outside.

6. The method according to claim 5 wherein the press producing the article with said punch, die and bottom forming tool does not affect the continuity of the inside or outside coatings.

7. A drawing and ironing punch having a hollow inside and circular cross-section with an outside wall adapted to selectively iron as the stroke of said punch forces a thin sheet of material through an ironing die and simultaneously during a part of the punch stroke into contact with an axially aligned bottom profiling tool comprising:

a first diameter of punch cross-section sufficient to produce ironing of said material between said die and said punch during initial punch stroke;

a second diameter of said punch cross-section located axially along in the direction opposite of the initial punch forming stroke and being of an amount such that ironing does not occur, a transition ramp between said first and second diameters being axially located to first remove the ironing load during initial application of bottom profiling, and a third diameter of punch cross-section substantially the same as said first diameter and located further axially along in the direction opposite punch stroke for resuming ironing of said side wall near the end of the application of bottom profiling.

8. The punch of claim 7 wherein said transition ramp is angled at less than 1° relative to the axis of said punch.

9. The punch of claim 7 wherein said second diameter is about 0.002" less than said first diameter.

10. The punch of claim 7 wherein said transition ramp begins at a point in the travel of said punch greater than one-half the stroke.

11. The punch of claim 7 combined with a axially aligned bottom profiling tool which contacts the thin sheet of material near the end of said punch stroke stretching and pulling material thereacross to form a thin walled hollow cylindrical container with a profiled bottom and a partially ironed side wall.

* * * * *